US006625196B2

(12) United States Patent
Lopes de Albuquerque

(10) Patent No.: US 6,625,196 B2
(45) Date of Patent: Sep. 23, 2003

(54) CONTAINER MADE OF ALUMINUM AND STAINLESS STEEL FOR FORMING SELF-BAKING ELECTRODES FOR USE IN LOW ELECTRIC REDUCTION FURNACES

(75) Inventor: Hélio Cavalcante Lopes de Albuquerque, Santos Dumont-MG (BR)

(73) Assignee: Companhia Brasileira Carbureto de Calcio (BR)

( * ) Notice: Subject to any disclaimer, the term of this patent is extended or adjusted under 35 U.S.C. 154(b) by 0 days.

(21) Appl. No.: 09/921,080

(22) Filed: Aug. 2, 2001

(65) Prior Publication Data

US 2002/0021737 A1 Feb. 21, 2002

(51) Int. Cl.[7] ..... H05B 7/107
(52) U.S. Cl. ..... 373/97; 373/89
(58) Field of Search ..... 373/89, 91, 97; 204/294, 286.1, 286.2, 286.4, 225; 252/511; 264/105, 451, 486, 449

(56) References Cited

U.S. PATENT DOCUMENTS

| | | | | | |
|---|---|---|---|---|---|
| 1,440,724 | A | * | 1/1923 | Soderberg | 373/89 |
| 1,441,037 | A | | 1/1923 | Soderberg | 373/89 |
| 1,498,582 | A | | 6/1924 | Soderberg | 373/89 |
| 1,544,151 | A | | 6/1925 | Helfenstein | 445/51 |
| 1,579,824 | A | | 4/1926 | Laurell | 313/327 |
| 1,613,212 | A | | 1/1927 | Westly | 313/238 |
| 1,679,284 | A | | 7/1928 | Westly | |
| 1,686,474 | A | | 10/1928 | Soderberg | |
| 1,691,505 | A | | 11/1928 | Walther | 373/97 |
| 1,723,582 | A | | 8/1929 | Sem | 313/327 |
| 2,337,279 | A | | 12/1943 | Sem et al. | |
| 2,666,087 | A | * | 1/1954 | Johansson et al. | 373/89 |
| 3,365,533 | A | | 1/1968 | Alexander | 13/18 |
| 3,438,876 | A | | 4/1969 | Marshall | 204/67 |
| 3,465,085 | A | | 9/1969 | Yonemochi | |
| 3,513,245 | A | | 5/1970 | Sullivan | 13/14 |
| 3,524,004 | A | | 8/1970 | Van Nostran et al. | |
| 3,534,004 | A | | 10/1970 | Luvisi et al. | 260/78.5 |
| 3,595,977 | A | * | 7/1971 | Orlando | 373/89 |
| 3,619,465 | A | | 11/1971 | Caavigli | |
| 3,622,141 | A | | 11/1971 | Brusa | 266/33 S |
| 3,715,439 | A | * | 2/1973 | Persson | 373/89 |
| 3,814,566 | A | | 6/1974 | Stroup | 425/144 |
| 3,819,841 | A | | 6/1974 | Persson | |
| 3,878,070 | A | | 4/1975 | Murphy | 204/64 |
| 3,888,747 | A | | 6/1975 | Murphy | 204/67 |
| 3,913,058 | A | | 10/1975 | Nishio et al. | 338/28 |
| 3,979,205 | A | | 9/1976 | Wanzenberg | 75/10 R |

(List continued on next page.)

FOREIGN PATENT DOCUMENTS

| | | |
|---|---|---|
| FR | 1556531 | 12/1967 |
| GB | 137811 | 9/1919 |
| JP | 51-10561 | 4/1976 |
| JP | 51-10562 | 4/1976 |
| JP | 53-32322 | 9/1978 |
| JP | 59-232250 | 12/1984 |
| JP | 60-103151 | 6/1985 |
| NR | PI 8700087-3 | 1/1987 |

*Primary Examiner*—Tu Ba Hoang
(74) *Attorney, Agent, or Firm*—Timothy J. Troy; Jennifer S. Warren; Roger K. Gobrogge

(57) ABSTRACT

The present invention relates to a self-baking electrode for use in low electric reduction furnaces, and refers particularly to a container (1) for the formation of self-baking electrodes to be used in low electric reduction furnaces, allowing the manufacture of silicon alloys with iron content as low as 0.25%, The container comprising an aluminum cylindrical casing (11) split in two parts containing therein a plurality of stainless steel ribs (12) uniformly attached perpendicularly along the inner surface of the casing (11) lengthwise along the cylindrical casing (11), wherein the cylindrical casing (11) is made of aluminum plates and the ribs (12) are made of stainless steel plates.

8 Claims, 3 Drawing Sheets

U.S. PATENT DOCUMENTS 4,021,318 A 5/1977 Yano et al. ..... 204/67
4,122,294 A 10/1978 Frolov
4,124,465 A 11/1978 Schmidt-Hatting et al. . 204/147
4,133,968 A 1/1979 Frolov
4,147,887 A 4/1979 Yasukawa et al.
4,181,583 A 1/1980 Steiger et al. ..... 204/67
4,209,377 A 6/1980 Shinohara et al. ..... 204/195 S
4,209,378 A 6/1980 Schinohara et al. ..... 204/195 S
4,224,128 A 9/1980 Walton ..... 204/243 R
4,229,627 A 10/1980 Rostron ..... 75/206
4,338,177 A 7/1982 Withers et al. ..... 204/243 R
4,342,637 A 8/1982 Withers et al. ..... 204/282
4,349,910 A 9/1982 Belz ..... 373/91
4,385,930 A 5/1983 Persson ..... 75/10 R
4,392,926 A 7/1983 Ohta et al. ..... 204/67
4,409,073 A 10/1983 Goldberger ..... 204/67
4,417,345 A 11/1983 Krogsrud ..... 373/101
4,424,584 A 1/1984 Evensen ..... 373/97
4,438,516 A 3/1984 Krogsrud ..... 373/97
4,447,906 A 5/1984 Persson ..... 373/72
4,458,352 A 7/1984 Tuovinen et al. ..... 373/101
4,481,637 A 11/1984 Evensen ..... 373/89
4,527,329 A 7/1985 Bruff et al. ..... 29/825
4,575,856 A 3/1986 Persson ..... 373/89
4,609,249 A 9/1986 Hornack et al. ..... 339/263
4,612,151 A 9/1986 Bruff et al. ..... 264/105
4,629,280 A 12/1986 Semmler et al. ..... 339/263
4,659,442 A 4/1987 Naterstad et al. ..... 204/67
4,677,850 A 7/1987 Miura et al. ..... 73/204
4,682,496 A 7/1987 Miura et al. ..... 73/204
4,692,929 A 9/1987 Cavigli et al. ..... 373/89
4,696,014 A 9/1987 Orrling ..... 373/89
4,722,684 A 2/1988 Kvivik ..... 432/225
4,724,021 A 2/1988 Martin et al. ..... 156/89
4,725,161 A 2/1988 Dagata ..... 403/267
4,726,892 A 2/1988 Foulkes ..... 204/294
4,736,384 A 4/1988 Sakai et al. ..... 373/92
4,737,247 A 4/1988 Jarrett et al. ..... 204/67
4,745,619 A 5/1988 Strobele ..... 373/96
4,756,004 A 7/1988 Stanley et al. ..... 373/89
4,756,813 A 7/1988 Stanley ..... 204/286
4,756,814 A 7/1988 Van Voren et al. ..... 204/294
4,770,826 A 9/1988 Vanvoren ..... 264/40.4
4,784,733 A 11/1988 Cutshall et al. ..... 204/67
4,867,848 A 9/1989 Cordier et al. ..... 201/6
4,885,073 A 12/1989 Guangchun et al. ..... 204/291
4,897,170 A 1/1990 Chandramouli ..... 204/294
5,071,534 A 12/1991 Holmen et al. ..... 204/245
5,110,427 A 5/1992 Meyer ..... 204/67
5,117,439 A 5/1992 Dagata et al. ..... 373/88
5,128,012 A 7/1992 Olsen ..... 204/245
5,146,469 A 9/1992 Svana ..... 373/89
5,275,705 A 1/1994 Bethune et al. ..... 204/173
5,351,266 A 9/1994 Bullon Camarasa et al. . 373/89
5,380,416 A 1/1995 McMinn ..... 204/245
5,397,450 A 3/1995 Sekhar et al. ..... 204/243 R
5,473,416 A 12/1995 Endou et al. ..... 355/246
5,473,628 A 12/1995 Tokvam et al. ..... 373/110
5,476,728 A 12/1995 Nakano et al. ..... 428/692
5,477,357 A 12/1995 Suzuki et al. ..... 359/67
5,500,399 A 3/1996 Faure et al. ..... 502/244
5,507,933 A 4/1996 de Nora et al. ..... 204/243 R
5,510,918 A 4/1996 Matsunaga et al. ..... 359/88
5,535,236 A 7/1996 Fischer ..... 373/89
5,577,065 A 11/1996 Sales ..... 373/89
5,582,695 A 12/1996 Olsen ..... 204/279
5,585,695 A 12/1996 Kitai ..... 313/506
5,587,869 A 12/1996 Azumi et al. ..... 361/301.3
5,600,460 A 2/1997 Yamamoto et al. ..... 349/54
5,654,976 A 8/1997 Cowx et al. ..... 373/79
5,693,211 A 12/1997 Olsen ..... 205/391
5,698,896 A 12/1997 Komatsu et al. ..... 257/705
5,734,000 A 3/1998 Popall et al. ..... 528/32
5,778,021 A 7/1998 Innavær ..... 373/89
5,785,768 A 7/1998 Nakata ..... 136/250
5,815,063 A 9/1998 Goto et al. ..... 338/22
5,822,358 A 10/1998 Johansen ..... 373/89
5,841,088 A 11/1998 Yamaguchi et al. ..... 218/158
5,844,122 A 12/1998 Kato ..... 73/1.06
5,854,807 A 12/1998 Boisvert et al. ..... 373/89
5,939,012 A 8/1999 Stanley ..... 264/472

* cited by examiner

CONTAINER MADE OF ALUMINUM AND STAINLESS STEEL FOR FORMING SELF-BAKING ELECTRODES FOR USE IN LOW ELECTRIC REDUCTION FURNACES

FIELD OF THE INVENTION

The present invention relates to a self-baking electrode for use in low electric reduction furnaces, and in particular it relates to a container for forming self-baking electrodes to be used in low electric reduction furnaces. The invention also relates to a method of forming a self-baking electrode using this container as well as the electrode formed thereby. Finally, the invention relates to the use of a self-baking electrode formed in this container for manufacturing silicon alloys.

BACKGROUND OF THE INVENTION

Conventional self-baking electrodes are formed in a segmented cylindrical container (sections of casing) arranged vertically extending from the inside of the furnace stack until the uppermost height of the building thereof. The upper end of the cylindrical container is open in order to allow the addition of unbaked electrode paste, which when submitted to heating, due to the heat added in the area of supply of electric operating current to the electrode, softens, melts, discharges volatile products, and is thereafter baked into a solid carbon electrode. As the electrode is consumed in the furnace, the electrode is lowered and new sections of casing are installed at the top of the column, where the unbaked electrode paste is then added.

A conventional electrode of this type is equipped with metallic ribs affixed to the inner surface of the vertical casing, the ribs extending radially relative to the axis of the electrode. When a new section of casing is installed at the top of the electrode column, its casing and its ribs are welded to the casing and ribs of the already installed segment in order to obtain continuity of the ribs in the vertical direction. The ribs serve to support, conduct electric current and heat into the electrode during the baking process. To compensate for the consumption of the electrode, the same is lowered into the furnace by means of the sliding mechanism.

When conventional electrodes of this type are used, the electrode container casing and the inner ribs melt when the electrode is being consumed in the furnace. The metal content of the casing and the ribs is transferred to the product in the furnace. Since the container casing and the inner ribs usually are made from carbon steel, such self-baking electrodes can not be used in electric reduction furnaces for the production of high-grade silicon alloys, as the iron content in the produced material will become unacceptable.

In the 1920's it was proposed to conduct heat into the self-baking electrodes through inserts of pre-baked carbon bodies in the unbaked electrode paste. In Norwegian patent NO 45408 there is disclosed a method for the production of self-baking electrodes wherein pre-baked carbon bodies are placed in the periphery of the electrodes and are kept in place by the unbaked electrode paste. The carbon inserts are not attached to the casing, but are merely kept in place by the unbaked electrode paste, and when the electrode is baked, by the baked electrode paste. In order to keep the carbon inserts in place before, during, and after the baking of the electrode paste, it is necessary that each casing be fully filled with hot liquid electrode paste when a new length of casing is installed at the top of the electrode column, since it is only the electrode paste that keeps the carbon inserts in place against the inner wall of the casing, which may render difficult the calcination of the central part of the electrode. Those carbon inserts will not function in the same manner as the ribs used in the conventional self-baking electrodes. The method in accordance with Norwegian patent NO 45408 has for these reasons not found any practical use.

There have been proposed over the years, however, a number of modifications of the conventional self-baking electrodes not having inner ribs made of steel in order to avoid contamination of the silicon produced in the furnace caused by the iron product of the casing and the ribs.

In Norwegian patent NO 149451 there is disclosed a self-baking electrode wherein the electrode paste contained in a casing devoid of ribs, is being baked above the location where the electric operating current is supplied, and wherein the casing is removed after baking, but before having been lowered down to the place where the electric operating current is supplied. An electrode is produced in this manner, which has neither casing nor ribs.

That kind of electrode has been used in low furnaces for the production of silicon, but nevertheless having the disadvantage when compared with conventional prebaked electrodes in that costly equipment must be installed in order to bake the electrode and to remove the casing from the electrode.

In U.S. Pat. No. 4,692,929 there is described a self-baking electrode to be used with electric furnaces for the production of silicon. The electrode comprises a permanent metal casing without ribs and a support frame for the electrode comprising carbon fibers, wherein the baked electrode is being held by the support frame. That electrode has the disadvantage that special fastening equipment must be arranged above the top of the electrode in order to hold the same using the support structure comprising carbon fibers. Furthermore, it may be difficult to have the electrode slide downwards through the permanent casing when the electrode is being consumed.

In U.S. Pat. No. 4,575,856 there is disclosed a self-baking electrode having a permanent casing without ribs, wherein the electrode paste is being baked over a central graphite core and wherein the electrode is being held by the graphite core. That electrode has the same disadvantages as the electrode according to U.S. Pat. No. 4,692,929 and in addition the graphite core is prone to breakage when the electrode is subjected to radial forces.

The methods cited above for the production of a self-baking electrode without ribs suffer from the disadvantage that they cannot be used for electrodes with a diameter above 1.2 m without substantially increasing the probability of breakage. However, conventional self-baking electrodes are used that have diameters of up to 2.0 m.

In U.S. Pat. No. 5,778,021 is disclosed a container for the formation of self-backing electrodes for use in low electric reduction furnaces, the container comprising a stainless steel cylindrical casing containing therein a plurality of stainless steel ribs perpendicularly attached along the inner surface of the casing lengthwise of the cylindrical casing.

Great Britain Patent Publication No. 137811 discloses a metallic container for electrodes for electric furnaces. The container has a casing provided with internal ribs. Holes are provided in the casing but not in the ribs.

U.S. Pat. No. 3,513,245 discloses an apparatus for joining shell sections of electrodes for electric arc furnaces made in sections, each section having a steel cylindrical casing having internal radial ribs

SUMMARY OF THE INVENTION

The present invention relates to a self-baking carbon electrode produced in direct connection with the furnace wherein the same is consumed, comprising an outer casing made of an electrically conductive material (aluminum), with inner ribs radially and vertically affixed. Electrode paste is initially added to the casing in raw unbaked form. With the passage of the electric current through the same, it is baked and forms the solid electrode.

It is therefore an object of the present invention to provide a container for the formation of self-baking electrodes to be used in low electric reduction furnaces, comprising a cylindrical casing containing in the inside thereof a plurality of ribs attached perpendicularly along the inner surface of the casing in the longitudinal direction of the cylindrical casing, wherein the cylindrical casing is made of aluminum plates and the ribs are made of stainless steel plates. If desired, the container can be split in 2 parts.

It is another object of the invention to provide a method of forming a self baking electrode comprising adding unbaked electrode paste to a container comprising an aluminum cylindrical casing containing therein a plurality of stainless steel ribs perpendicularly attached along the inner surface of the casing lengthwise of the cylindrical casing and heating the paste by a method selected from heat supplied by a heater, heat generated by the introduction of electric energy, and a combination thereof.

It is yet another object of the invention to provide an electrode formed by this method.

It is yet another object of the invention to provide a method for manufacturing silicon alloys with low iron content using a self baking electrode, the improvement comprising forming the self baking electrode in an electrode container comprising an aluminum cylindrical casing containing therein a plurality of stainless steel ribs perpendicularly attached along the inner surface of the casing lengthwise of the cylindrical casing.

BRIEF DESCRIPTION OF THE DRAWINGS

The following drawings and descriptions provide a representative embodiment of the invention, but the limitations included therein are not meant to limit the invention or narrow the scope of the claims.

DETAILED DESCRIPTION OF THE INVENTION

Although the methods and apparatuses mentioned above for the production of self-baking electrodes are intended to avoid iron contamination in the product produced in low furnaces, there is still a need for a simple and reliable self-baking carbon electrode, able to overcome the disadvantages of the known electrodes. It is therefore an object of the present invention to provide a container for a self-baking carbon electrode which, when in operation, may allow the production of high-grade silicon alloys.

Accordingly, the present invention refers to a self-baking carbon electrode produced in direct connection with the furnace wherein the same is consumed, comprising an outer casing made of an electrically conductive material (aluminum), with inner ribs radially and vertically affixed. Electrode paste is initially added to the casing in raw unbaked form. With the passage of the electric current through the same, it is baked and forms the solid electrode.

Figure 1:
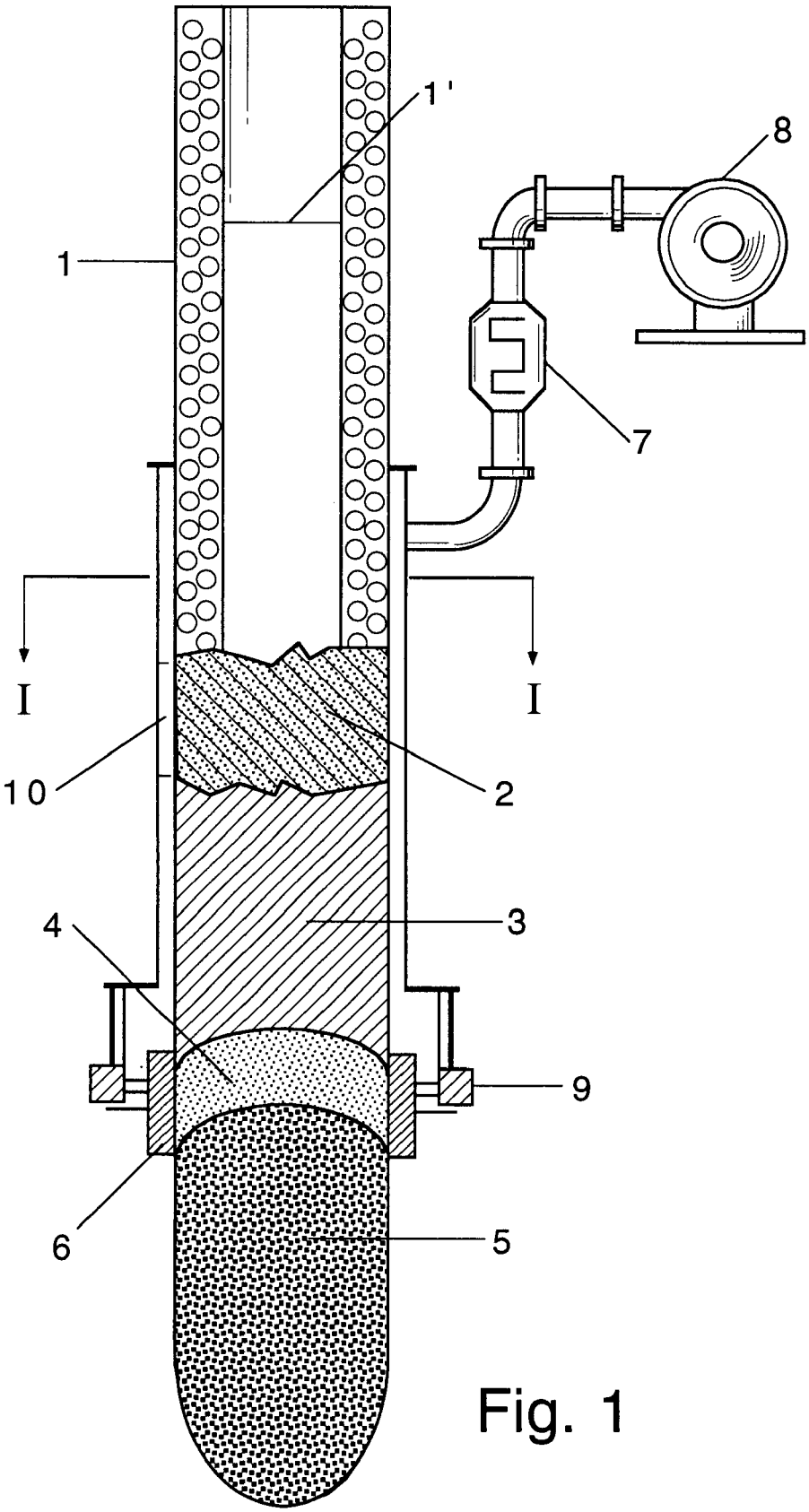
FIG. 1 is a cross-sectional view through the container for the formation of self-baking electrodes to be used in low electric reduction furnaces in accordance with the present invention, with the electrode placed inside the same.

As may be seen in FIG. 1, the self-baking electrode is formed by a cylindrical container (1), which is segmented in casing sections (1'). The container (1) can extend from the inside of the furnace stack until the uppermost height of the building housing the same.

The upper end of the cylindrical container (1) is open to allow the addition of unbaked electrode paste (2). The formation of the electrode takes place through the transformation of the raw unbaked electrode paste (2) into fluid paste (3), paste being calcined (4) and calcined paste (5) due to the heat supplied by the hot air blown-in (originating from fan (8) and from heater (7)), as well as by the heat generated by the introduction of electric energy through the contact plates (6), which are pressed against the electrode by pressure ring (9). The casing segments above the contact plates are enclosed by the protective shield (10) for a sufficient distance starting at, for example, 2.5 cm above the contact plates.

Figure 2:
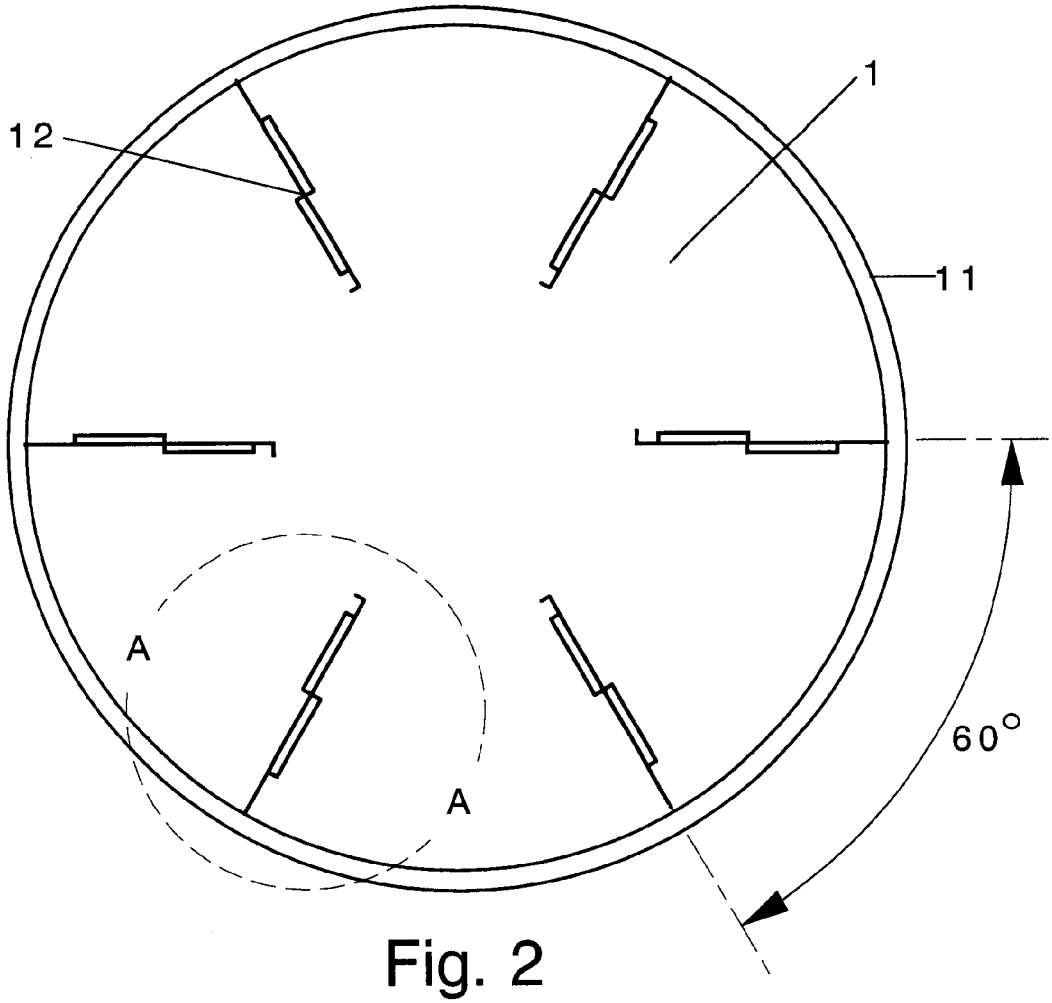
FIG. 2 is a horizontal view taken along plane I—I of the container depicted in FIG. 1.

In FIG. 2 there is depicted the container (1), seen in cross section along the plane I—I of FIG. 1. As will be noted, the container (1) is comprised of a cylindrical casing (11), made of aluminum plates, and which includes in the inside thereof a plurality of ribs (12) attached perpendicularly to the inner wall of the casing (11). Preferably, the ribs (12) are attached uniformly on the inner wall of the casing (11). The ribs (12) are made of stainless steel.

Figure 3:
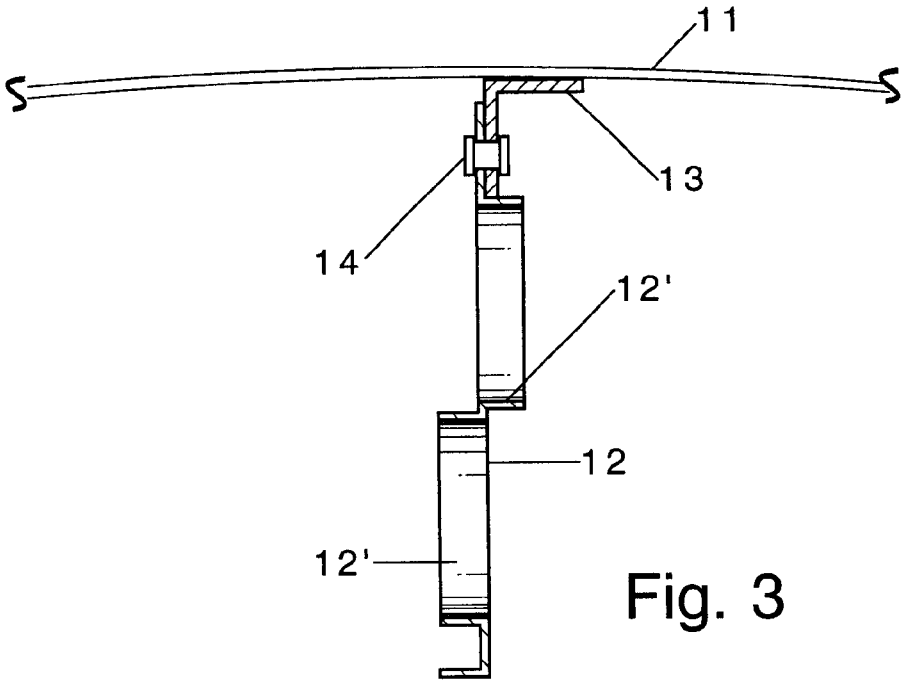
FIG. 3 is an enlarged view of area "A" marked in FIG. 2 and showing the attachment of the ribs to the aluminum casing.

FIG. 3 shows an enlarged view of area "A" marked in FIG. 2, showing the attachment of stainless steel rib (12) to the aluminum casing (11). Since the metals of the rib and the casing are different, the rib (12) is fastened by means of a rivet (14) to an aluminum angle bar (13), which is welded to the inner surface of the casing (11) of container (1). The drawn back portions of the holes in the rib (12') are on alternating sides of the rib (12).

Figure 4:
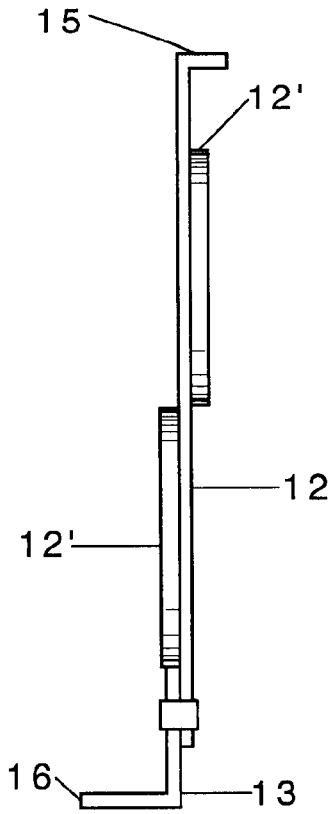
FIG. 4 depicts the fold and drawn back portions of the holes provided in the rib.

FIG. 4 depicts the construction of the stainless steel rib (12) in side view, and showing the drawn back portions (12'), the fold (15) and the point of attachment (16) of the angle bar (13) to the casing (11).

Figure 5:
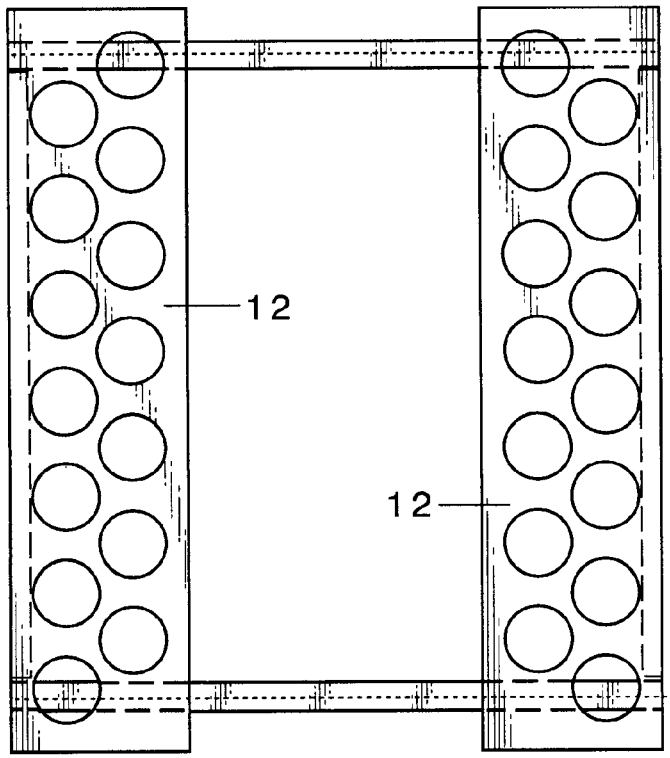
FIG. 5 shows the alternating and offset holes provided in the rib.

FIG. 5 is a front view of the ribs (12) in the position of attachment to the casing, wherein the holes are shown to be offset and alternating.

Figure 6A:
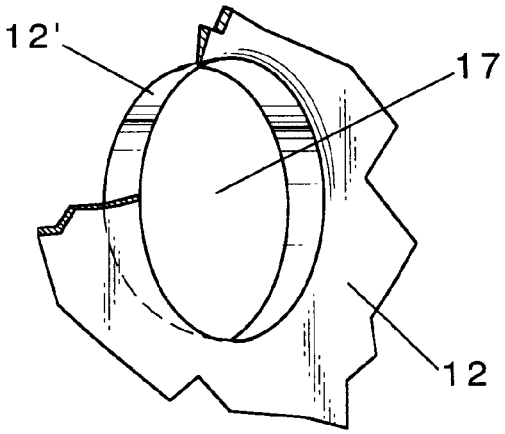
FIGS. 6A and 6B are front and rear views of the hole provided in the rib.
Figure 6B:
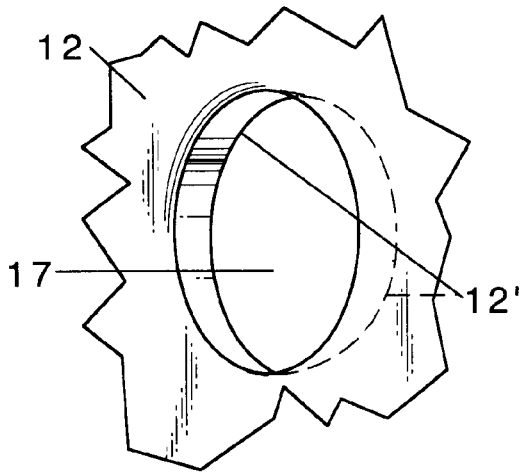

FIG. 6A is a front view of one of the holes (17) in the rib (12) showing the drawn back portion (12') that forms the flange around the hole. FIG. 6B is a rear view of the same hole (17) in the rib (12) showing the drawn back portion (12') that forms the flange around the hole.

The ribs are made of stainless steel plates with low iron content and with dimensions sufficient to withstand the weight of the electrode column.

If the material used to form the casing is aluminum, the ribs must be riveted to an aluminum angle bar, which is welded to the inside of the aluminum casing.

The assembly of the casings follows the same principle adopted for the conventional carbon steel casings.

The ribs generally extend beyond both ends of the casing in order to allow the welding thereof and to ensure their continuity. In a preferred embodiment of the invention, the ribs extend on the order of 20 mm beyond the ends of the casing.

The present invention allows for a decrease in the contribution of "Iron" to the product through the casings compared to the traditional model (manufactured from carbon steel). This decrease can be on the order of 91% allowing the production of silicon alloys with "Iron" content down to 0.25 wt. %. As used herein, the expression ""Iron" content down to 0.25 wt. %" means that a specification for this material would list 0.25 wt. % as the maximum "Iron" content for the material.

In a preferred embodiment, the ribs are attached by means of aluminum rivets to an aluminum angle bar, which is welded to the inside of the aluminum casing.

In a further embodiment, the ribs comprise a folded portion at the interior end thereof.

In another preferred embodiment, the ribs are attached uniformly on the inner wall of the casing.

In a still further embodiment, the container may comprise ribs provided with alternating circular holes offset from the horizontal axis passing through the center of the same. In yet another embodiment, the holes in the rib are drawn back for further support.

That which is claimed is:

1. A container made of aluminum and stainless steel for the formation of self-baking electrodes for use in low electric reduction furnaces comprising an aluminum cylindrical casing containing therein a plurality of stainless steel ribs perpendicularly attached along the inner surface of the casing lengthwise of the cylindrical casing, wherein each rib has holes arranged alternately and offset from the horizontal axis that passes through the center of the holes and each rib is attached by means of rivets to an aluminum angle bar which is welded to the inner surface of the aluminum casing, each said rib having its own said angle bar for attachment.

2. A container made of aluminum and stainless steel for the formation of self-baking electrodes for use in low electric reduction furnaces comprising an aluminum cylindrical casing containing therein a plurality of stainless steel ribs perpendicularly attached along the inner surface of the casing lengthwise of the cylindrical casing, wherein each rib has holes that are drawn back and each rib is attached by means of rivets to an aluminum angle bar which is welded to the inner surface of the aluminum casing, each said rib having its own said angle bar for attachment.

3. A container according to claim 1, wherein the ribs have folds at their ends furthest from the cylindrical casing.

4. A container according to claim 2, wherein the ribs have folds at their ends furthest from the cylindrical casing.

5. A container according to claim 2, wherein the ribs have holes arranged alternately and offset from the horizontal axis that passes through the center of the holes.

6. A container according to claim 1, wherein the ribs have holes that are drawn back.

7. A container according to claim 1, wherein the container further comprises electrode paste.

8. A container according to claim 2, wherein the container further comprises electrode paste.

* * * * *